United States Patent [19]

Reitzel

[11] 3,999,758

[45] Dec. 28, 1976

[54] RACING GAME

[75] Inventor: John S. Reitzel, Tarzana, Calif.

[73] Assignee: Steven L. Gail, North Hollywood, Calif.

[22] Filed: June 9, 1975

[21] Appl. No.: 585,257

[52] U.S. Cl. ..... 273/86 D

[51] Int. Cl.[2] ..... A63H 18/14

[58] Field of Search ..... 273/86 R, 86 B, 86 D, 273/86 E, 86 F, 86 G, 86 H

[56] References Cited

UNITED STATES PATENTS

| | | | |
|---|---|---|---|
| 1,553,909 | 9/1925 | Moeller | 273/86 F |
| 1,581,757 | 4/1926 | Mills | 273/86 F |
| 3,190,652 | 6/1965 | Dunn | 273/86 R |

FOREIGN PATENTS OR APPLICATIONS

| | | | |
|---|---|---|---|
| 657,431 | 1/1929 | France | 273/86 E |

*Primary Examiner*—Anton O. Oechsle
*Attorney, Agent, or Firm*—Harvey S. Hertz

[57] ABSTRACT

A racing game formed of a plurality of equal length tracks. A movable member is positioned on each of the tracks and contains a pair of track engaging members positioned thereon. A pair of drives are movable along each of the tracks for advancing the position of the movable members along the tracks. Each of the drives move at different speeds and are each formed of endless belts. The drives are mounted so that they continuously move from one side of one track to one side of the adjacent track. The drive is formed of a continuous length belt having randomly spaced teeth thereon. As the belt moves the teeth cause the movable members to move along the track. The track engaging members may be formed with different spacings for different movable members, thus increasing the probability that the interval of time that each movable member completes movement along the entire distance of the track differs for each member.

7 Claims, 13 Drawing Figures

FIG.1.
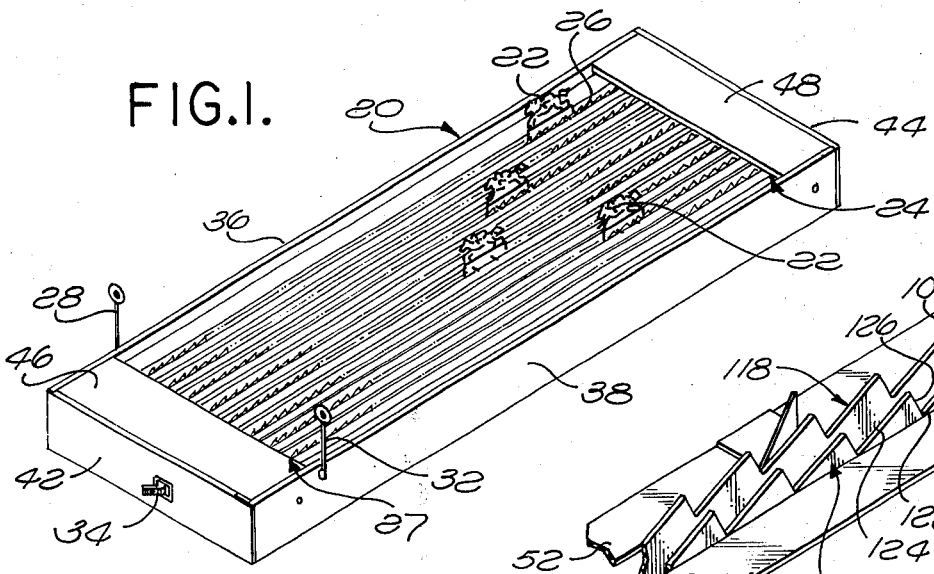
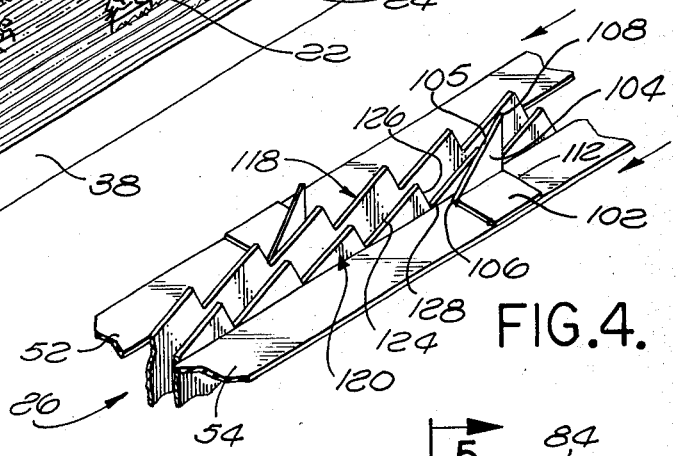
FIG.4.
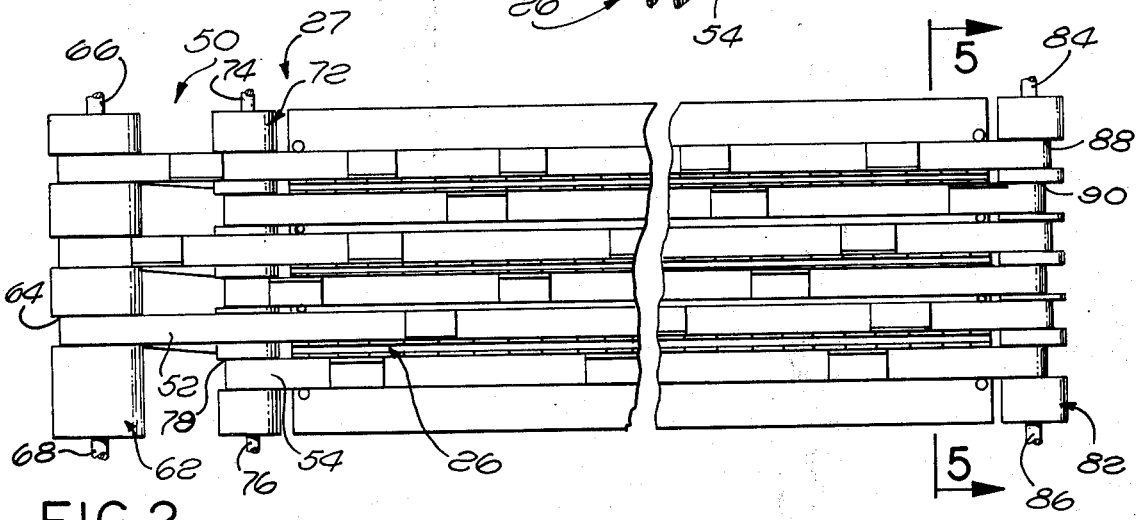
FIG.2.
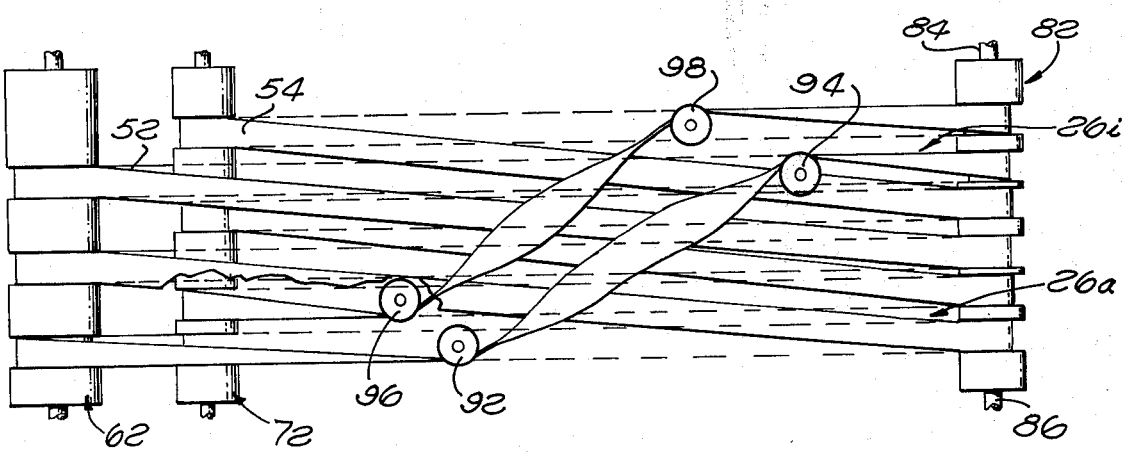
FIG.3.

RACING GAME

BACKGROUND OF THE INVENTION

1. Field of the Invention

The field of art to which the invention pertains includes the field of racing games, particularly with respect to a game formed of a plurality of movable members which are propelled along separate parallel tracks.

2. Description of the Prior Art

Conventional mechanical racing games usually depend on frictional contact between the drive mechanism and racing members. This technique makes the odds of a racing member winning depend on accidents of manufacture or wear that are difficult to control. Further, unknown to the players, techniques such as oiling a racing member drive surface can be utilized to control the chances of one racing member winning.

The present invention provides a racing game wherein movable members can be mechanically moved along a plurality of parallel tracks. Means are formed on each of the movable members so that the chance for each member winning the racing game varies in accordance with a predetermined and calculable manner. The drive for moving each of the members is random so that an additional element of chance determines which movable member first moves the entire length of the track. The racing members are advanced randomly, by a positive mechanism that is not affected by small uncontrollable or concealable variations in the racing members of the tracks. The racing member can advance by "spurts", so that the race lead may change several times in the course of a race. The movement of the racing members simulate lifelike animal movement.

SUMMARY OF THE INVENTION

A racing game is formed of a plurality of equal length tracks. A movable member is positioned on each of the tracks. Each movable member has track engaging means positioned thereon. A drive means is movable along each of the tracks for advancing the position of the movable members along the track.

The advantages of this invention both as to its construction and mode of operation will be readily appreciated as the same becomes better understood by reference to the following detailed description when considered in connection with the accompanying drawings in which like reference numerals designate like parts throughout the figures.

BRIEF DESCRIPTION OF THE DRAWINGS

FIG. 1 is a perspective view of the racing game in accordance with the principles of the invention;

FIG. 2 is a partial top planar view of the racing game track of FIG. 1;

FIG. 3 is a bottom partial planar view of the track of FIG. 1;

FIG. 4 is a partial perspective view illustrating one of the tracks used in the racing game of FIG. 1;

DESCRIPTION OF THE PREFERRED EMBODIMENT

Figure 5:
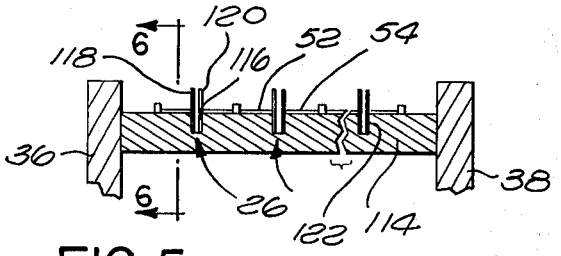
FIG. 5 is a cross-sectional view of the track taken along the line 5—5 of FIG. 2.

Referring now to the drawings, there is shown in FIG. 1 a racing game apparatus constructed in accordance with the principles of the invention. The racing game apparatus comprises a generally rectangular frame 20 having a plurality of racing game members 22 mounted thereon. In playing the game each of the members are normally placed at the starting line end 24 of the frame and are moved by a drive mechanism, as explained hereinafter, along their own respective tracks 26. The racing member 12 which first arrives at the finish line end 27 of the game, illustrated by a pair of posts 28 and 32 mounted on opposite sides of the frame is the "winner". A switch 34 is used to actuate the drive mechanism (not shown in FIG. 1), so that the racing game members will move at different speeds along their respective track 26.

The racing game apparatus frame 20 is formed of a support structure comprising a pair of rectangular side walls 36 and 38 which are joined together by a pair of end wall 42 and 44 to form the rectangular frame 20. The switch 34 is illustrated mounted in the end wall 42 and is connected to the drive mechanism, which is covered by a finish line end top plate 46 mounted adjacent the top edge of the end wall 42 and its junction with the side walls 36 and 38. Similarly a starting line end top plate 48 is used to cover a belt guide (not shown in FIG. 1) positioned adjacent the starting line end 24 of the frame 20.

Referring now to FIG. 2, there is illustrated a top view of a portion of the drive mechanism 50 used in the racing game apparatus of FIG. 1, with the frame 20 and the top plates 44 and 46 removed. The drive mechanism 50 is used to move a first endless drive belt 52 and a second endless drive belt 54. The drive belt 52 is moved along one side of each of the tracks 26 whereas the drive belt 54 is moved along the other side of each of the tracks 26. The first drive belt 52 is wound around a first enlarged diameter drive roller 62 with the first drive belt 52 being positioned in reduced diameter portions 64 formed in the first enlarged diameter drive roller 62. Normally, a reduced diameter portion 64 is formed in the roller 62 for each track 26 of the apparatus. The first drive roller 62 is mounted so that its end axles 66 and 68 can be rotatably mounted in the frame side walls 36 and 38, respectively.

A second drive roller 72 is spaced intermediate the first drive roller 62 and the finish line end 27 of the track. The second drive roller 72 contains end axles 74 and 76 which are rotatably positioned in the side walls 36 and 38 enabling the second drive roller 72 to rotate in a similar manner as the first drive roller 62. The second drive roller 72 further contains reduced diameter portions 79, of a different diameter than the reduced diameter portions 64 of roller 62, into which the second drive belt 54 is positioned. The reduced diameter portions 78 are spaced in planes intermediate the planes of the reduced diameter portions 64 of the first drive roller 62 so that there is no interference between the first drive belt 52 and the second drive belt 54.

A freely rotatable roller belt guide 82 is positioned directly below the starting line end top plate 48 of FIG. 1, and is mounted so that its reduced end tips 84 and 86 can rotate in the frame side walls 36 and 38, respectively. The roller belt guide 82 contains alternate reduced diameter portions 88 and 90 of two different diameters in alternation each of which are positioned in planes parallel to the reduced diameter portions 64 and 78 of the first and second drive rollers 62 and 72, respectively, so that the drive belts 52 and 54 can be positioned therein.

Referring now to FIG. 3 the bottom side of the track assembly of FIG. 2 is illustrated to show the manner with which the first drive belt 52 and the second drive belt 54 are continuously transported to adjacent tracks. The track 26*a* depicts the first track adjacent one of the side walls 36 of the frame. After the first drive belt 52 passes around the first drive roller 62 it is twisted at an angle of 90 degrees around a first tension bearing 92 and hence to a second tension bearing 94 adjacent the belt guide 82. Then the first drive belt 52 is positioned in a groove 88 of the belt guide 82 and forms the belt drive at one side of the last track 26*i*. As the first drive belt 52 passes around the first drive roller 62 it is then transmitted to the next adjacent track. Similarly the seond belt drive 54 passes from the first track 26*a* around the tension bearings 96 and 98 to the other side of the track 26*i*. (For purposes of clarity, FIGS. 2 and 3 have illustrated only three tracks 26, although the racing game can actually contain a minimum of two tracks up to an unlimited maximum number).

Referring now to FIG. 4, there is shown a perspective view of a portion of one of the tracks 26 illustrating the construction of the first drive belt 52 and the second drive belt 54. As can be readily seen each of the drive belts are relatively flat members typically of ribbon configuration and made of rubber or similar flexible type material. Alternatively, plastic material similar to movie film could be used as well, with the sprockets of the movie film being used to mesh with teeth (not shown) on the respective drive rollers 62 and 72. Support plates 102 are randomly spaced on each of the drive belts 52 and 54. Each of the support plates contain a tooth 104 mounted in a plane perpendicular to the plate and the belt and shaped in a triangular configuration, with the hypotenuse 105 of the tooth 104 sloping from the front end 106 of the plate (nearest the finish line 27 when the tooth 104 is rotated to the top of the frame 20) to a rear point 108. Normally, the rear point terminates in a plane parallel to the rear end 112 of the support plate. The support plates 102 are flexibly attached to the drive belts at their front edges only, so that they can pass freely around the rollers 62, 72, and 82.

Figure 6:
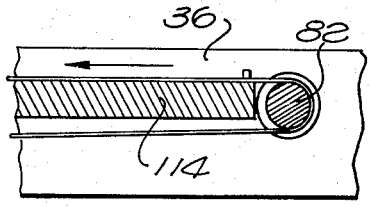
FIG. 6 is a partial cross-sectional view of the track taken along the line 6—6 of FIG. 5.

Referring now to FIG. 5, there is illustrated a cross-sectional view of the tracks 26 wherein a support base 114 of generally rectangular cross-section is positioned between the frame side walls 36 and 38 and extends from the starting line end 24 of the track to the finish line end 27 (the base has been removed from FIGS. 2 and 3 for purposes of clarity). A plurality of slots 116 are formed parallel to each of the tracks 26. As can be seen in FIG. 6, the drive belts 52 and 54 (one of which is illustrated) are spaced below the bottom surface of the support base 114 travel around the belt guide 82 and hence move along the top surface of the support base 114.

Referring now to FIG. 6, the drive belts 52 and 54 are each moved on opposite sides of the slots, and are spaced apart. The notched supports 118 and 120, respectively are identical and can be seen in greater detail in FIG. 4. The notched supports are formed of a plurality of tapered guides 122 which slope upwardly in the same direction as the tooth hypotenuse 105 at an angle of approximately 30° along a surface 124. Then the surface drops from a top point 125 at a sharp angle along a surface 126 to approximately the plane of the belts 52 and 54 to a low point 128 whereupon the surface 124 is repeated so that a plurality of equal ratchet like guides 122 are formed along each of the notched supports 118.

Figure 7:
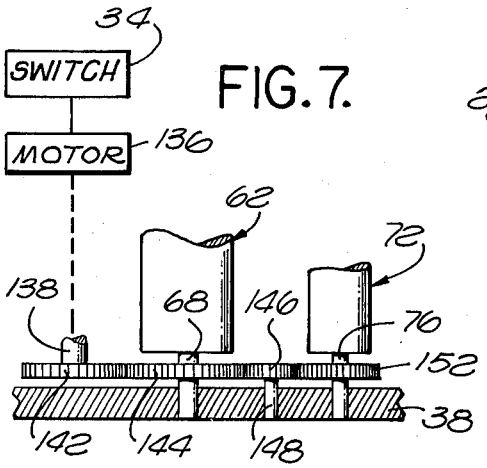
FIG. 7 is a schematic illustration of the drive system used in the racing game.

Referring now to FIG. 7 there is shown a schematic illustration of the drive system for moving the drive belts 52 and 54. When the switch 34 is actuated, the power from a source (not shown) is connected to a motor 36 causing the motor and its shaft 138 to rotate. A motor gear 142 is connected to the motor shaft 138 and rotates therewith. The motor gear 142 meshes with a first drive gear 144 mounted on the first drive roller axle 68. The first drive gear 144 rotation causes the first drive roller 62 to rotate hence moving the first drive belt 52, which is positioned in the grooves 64 drive roller. The first drive gear 144 meshes with an idler gear 146 which is freely rotatable on an axle 148 positioned in the frame side wall 38. The idler gear in turn meshes with a second drive gear 152. The second drive gear 152 is mounted on the end axle 76 of the second drive roller 72 and rotates therewith. Rotation of the second drive roller 72 in turn causes the second drive belt 54 to move along the support base 114 as previously explained.

Figure 8:
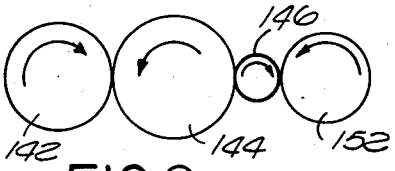
FIG. 8 is a schematic illustration of the gear drive of FIG. 7.

As can be seen in the schematic illustration of FIG. 8, clockwise movement of the motor gear 142 causes counterclockwise rotation of the first drive gear 134. Further, the idler gear 146 causes the second drive gear 152 to also rotate in a counterclockwise direction so that the drive belts 52 and 54 are both driven in the direction from the starting line end 24 to the finish line end 26 of the tracks. In addition, it should be noted that the first and second drive gears 144 and 152 are of different outer diameters in the same ratio as the reduced diameters 88 and 90, respectively of roller 82, so that the drive belts 52 and 54 move at different speeds.

Figure 9:
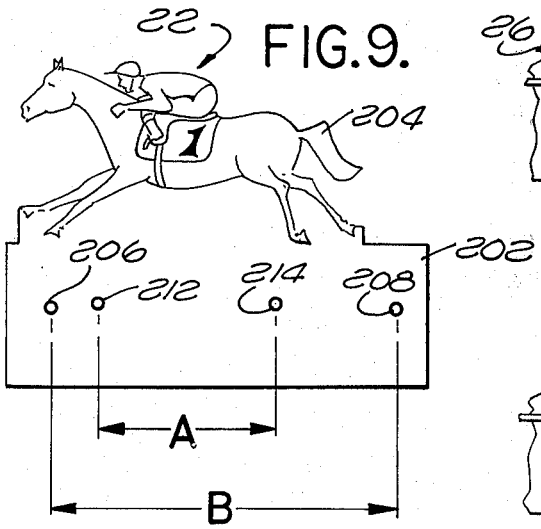
FIG. 9 is a planar view of one of the racing members used in the game of FIG. 1.

Referring now to FIG. 9 there is illustrated a typical racing game member 22. The racing game member is formed of a generally planar base 202 having a generally rectangular configuration and illustrated as containing a race horse and jockey 204 mounted on the top surface thereof. It should be understood that other type figures such as dogs, or rabbits, could be mounted on the base 202 as well. Alternatively, the figure can be omitted entirely. The base 202 is generally a thickness less than the spacing between the notch supports 118 an 120 so that it can fit into the slots 116.

Figure 10:
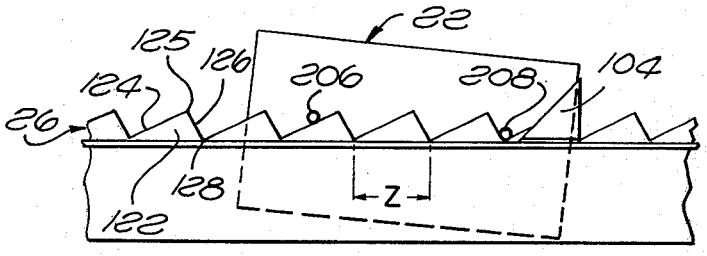
FIGS. 10 through 13 are partial side views of a portion of one of the tracks used to explain the operation of the game.

A pair of transverse mounting pins illustrated as a front track engaging pin 206 and a rear track engaging pin 208 are positioned normal to the plane of the base 202. The engaging pins 206 and 208 are illustrated as being spaced a distance "B" apart. These transverse track engaging pins 206 and 208 normally ride on the top surface of the notch supports 118 and 120 as illustrated in FIG. 10. Normally the different racing members 22 contain track engaging pins not all spaced the same distance apart.

In FIG. 9, a second set of pins 212 and 214 spaced a distance apart "A" are also illustrated. However, it should be understood that normally each racing member 22 contains only one pair of track engaging pins. As will be explained in greater detail hereinafter, the distance between the pair of track engaging pins of each racing member are spaced apart a distance not equal to the distance "Z" between low points 128 of adjacent ratchet guides 122 of the notch support or a multiple thereof. Moreover, the teeth 104 are randomly spaced along the drive belts 52 and 54, but are spaced a distance greater than the maximum spacing between the track engaging pins of any racing member plus the distance "X" over which the tooth 104 rises above the top point 125 of the guides 122, as will be explained in greater detail hereinafter.

Figure 11:
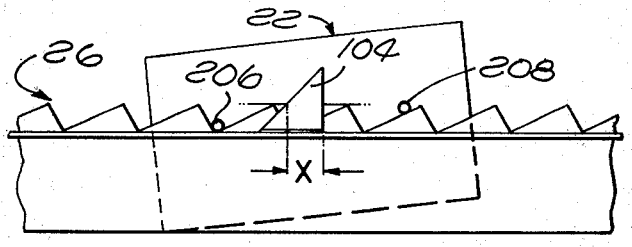

The rear track engaging pin 208 is illustrated resting at the guide low point 128 of a pair of adjacent ratchet guides 122. The front track engaging pin 126 is illustrated as resting on the surface 124 of a ratchet guide. As the tooth 104 approaches the rear track engaging pin 208 it lifts the member 22 sufficient so that the track engaging pin 208 is then positioned adjacent the surface 124 of the tooth while the front track engaging pin stops the racing game member from forward movement as it enters the guide low point 128 shown in FIG. 11.

Figure 12:
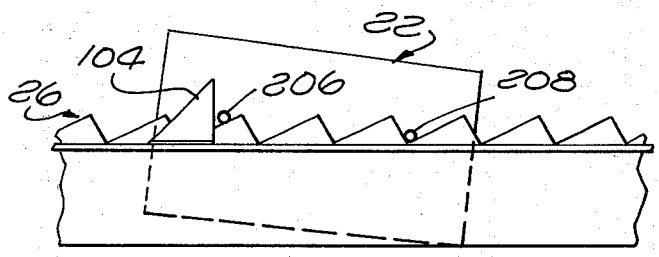

The tooth 104 then continues moving until it approaches the front track engaging pin 206. The tooth 104 then forces the front track engaging pin over the point 126 of the tooth as illustrated in FIG. 12 simultaneously causing the rear track engaging pin 208 to stop forward movement of the racing game member 22 as it rests in the guide low point 128. The racing member thus is returned to the position shown in FIG. 10 but it is advanced one ratched guide 122.

In normal play, the tooth 104 of either the drive belt 52 and 54 will move the racing game members one guide length. Should a ratchet tooth associated with one of the drive belts be in a position shown in FIG. 11, i.e. intermediate to track engaging pins 206 and 28 and a ratchet tooth associated with the other drive belt engage the rear track engaging pin 208, no movement of the racing game member will occur but the tooth of the second belt will merely raise the engaging pin 208 and then drop it in the same position. Thus, by spacing the track engaging pins 206 and 208 different distances apart, this latter described effect will occur less frequently where the track engaging pins are spaced a lesser distance apart such as the distance "A" rather than when the track engaging pins are spaced a greater distance apart such as distance "B". In other words, the racing member whose track engaging pins are spaced a lesser distance apart has a greater chance of moving along the track than does a racing member whose track engaging pins are spaced a greater distance apart.

In addition, if two of the teeth 104 of one of the drive belts have a spacing in the range between the distance between the track engaging pins such as "A" or "B" minus the length "X", and the distance between the track engaging pins plus the distance "X", the first tooth 104 engages the front track engaging pin 206 and the rear tooth engages the rear track engaging pin 208 and simultaneously carry the racing member along the track continuously, preventing a conventional racing game from occurring. Thus, the teeth 104 of each of the drives are never spaced a distance apart less than "X" plus the maximum distance between the track engaging pins of any racing member, so as to prevent such an occurrence.

Figure 13:
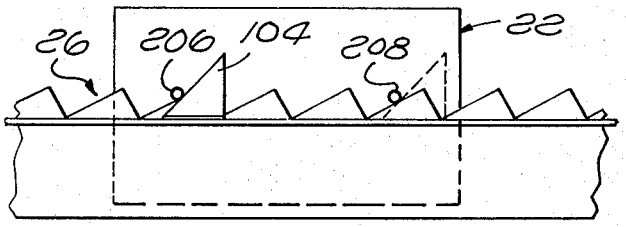

Referring now to FIG. 13 there is illustrated a game mode, where one of the teeth 104 of one of the drive belts is engaging the front track engaging pin 206 whereas the tooth of the second drive belt (shown in dotted lines) is engaging the rear track engaging pin 208. When this "coincidence" occurs, the racing member 22 is carried along the track until the drive belt teeth of the adjacent tracks are no longer spaced apart so as to engage both pins. The duration of any "coincidence" is limited because the belts 52 and 54 are moving at different speeds. However, for the short interval of time when the mode of FIG. 13 occurs, the racing member 22 moves along an inordinate amount of guides 122.

Thus, as can be readily seen, by spacing the track engaging pins 206 and 208 a different distance apart on some or all of the racing members, the odds of each of the racing members winning the game are varied. By providing two different drives each moving at a different velocity, and by having the teeth 104 spaced along these tracks at random spaces, there is a random chance that each racing member 22 will win the game. However, in accordance with the rules of probability, if the game is played a sufficient number of times, a racing member, whose track engaging pins are spaced closer together than the pins of another racing member, wins more games than the other member.

In addition, it should be noted that the racing member 22 whose track engaging pins are closer together, has a greater chance of winning the race when there are fewer teeth 104 on the drive belts 52 and 54, since there is less chance of "coincidence" of the teeth of two belts as previously described with respect to FIG. 13. The duration of the interval of "coincidence" can be varied by changing the slope of the tooth hypotenuse 105 to alter the distance "X". By increasing the number of notched guides 122 for each support, the winning chances of a racing member whose track engaging pins are closer together also increases, as the race time interval is increased.

Further, the gear and multiple drive roller arrangement formed by the rollers 62 and 72 can be replaced by a single roller having different sized reduced diameter sections for the drive belts 52 and 54, respectively, for enabling the drive belts to move at different speeds.

I claim:

1. A racing game comprising:

a plurality of equal length longitudinally extending tracks;

a movable member positioned on each of said tracks, each movable member having track engaging means positioned thereon; and a plurality of continuous drive means each having means mounted thereon for engaging said track engaging means and movable along each of said tracks for independently advancing the position of each of said movable members along said tracks at different rates said means mounted on said drive means having a path defined by movement along said tracks and successive movement to the next adjacent track.

2. A racing game in accordance with claim 1 wherein each said drive means comprises a continuous length belt having spaced teeth thereon, movement of said belt causing said teeth to move said track engaging means to transport said movable member along the length of said track.

3. A racing game comprising:

a plurality of equal length longitudinally extending tracks;

a movable member positioned on each of said tracks, each movable member having track engaging means positioned thereon;

drive means movable along each of said tracks for advancing the position of said movable members along said track;

said track engaging means each extending from said movable members in planes intersecting said longitudinally extending tracks; said track being formed with a plurality of notches spaced an equal distance along said track, said track engaging means being movable into and out of said notches; and wherein said track engaging means are formed of a pair of members spaced apart on said movable member, the distance between said track engaging means being greater than the spacing between two adjacent notches, said distance between said track engaging means being different than a multiple of the distance between notches for preventing both track-engaging means from simultaneously being positioned in said notches.

4. A racing game in accordance with claim 3 wherein said drive means comprises a continuous length belt having spaced teeth thereon, movement of said belt causing said teeth to move said track engaging means into and out of said notches for transporting said movable member along the length of said track.

5. A racing game in accordance with claim 4 wherein each of said tracks are formed of a pair of identical spaced-apart notched supports, with said members being movable in the space between said notch supports, said drive means belts being movable along one side of said notch supports.

6. A racing game in accordance with claim 5, wherein said drive means comprises a second belt movable along another side of said notch supports, said second drive belt containing spaced teeth thereon, said teeth moving said members along said track, said second drive belt moving at a speed different from said drive belt.

7. A racing game in accordance with claim 6 wherein said belts are simultaneously movable at different speeds.

* * * * *